US006028582A

United States Patent [19]

Drew et al.

[11] Patent Number: 6,028,582

[45] Date of Patent: Feb. 22, 2000

[54] SOLENOID FOR SCANNED FLIP-DISK SIGN IMPROVEMENTS

[75] Inventors: W. Brooks Drew, Winston-Salem; G. Frank Dye; F. Martin Black, both of Greensboro, all of N.C.

[73] Assignee: Reader Vision, Inc., Greensboro, N.C.

[21] Appl. No.: 08/831,071

[22] Filed: Apr. 1, 1997

[51] Int. Cl.[7] ..... G09G 3/34

[52] U.S. Cl. ..... 345/108; 345/55; 345/59; 340/815.59; 40/749; 40/430

[58] Field of Search ..... 345/55, 59, 105, 345/108, 109, 111; 40/430, 447, 449, 463, 735, 745, 749; 340/815.44, 815.55, 815.59, 815.62, 815.86

[56] References Cited

U.S. PATENT DOCUMENTS

| | | | |
|---|---|---|---|
| 3,267,595 | 8/1966 | Levy et al. | 345/111 |
| 3,482,344 | 12/1969 | Holloman | 40/28 |
| 3,706,148 | 12/1972 | Johnston | 40/77.7 |
| 3,949,392 | 4/1976 | Caritato | 340/336 |
| 4,264,906 | 4/1981 | Wakatake | 340/764 |
| 4,380,879 | 4/1983 | Seibert | 40/447 |
| 4,417,241 | 11/1983 | Wakatake | 340/815.05 |
| 4,429,478 | 2/1984 | Bruce-Sanders | 40/447 |
| 4,466,207 | 8/1984 | Salam | 40/449 |
| 4,597,209 | 7/1986 | Hukill | 40/447 |
| 4,729,067 | 3/1988 | Ohe | 362/26 |
| 4,761,905 | 8/1988 | Black | 40/447 |
| 4,769,638 | 9/1988 | Woolfolk | 340/763 |
| 4,779,082 | 10/1988 | Salam | 340/764 |
| 4,912,442 | 3/1990 | Black | 345/108 |
| 5,057,828 | 10/1991 | Rousseau | 345/111 |
| 5,063,377 | 11/1991 | Smith | 340/764 |
| 5,184,116 | 2/1993 | Daugherty et al. | 345/109 |
| 5,329,717 | 7/1994 | Follis | 40/605 |
| 5,412,891 | 5/1995 | Black et al. | 40/447 |
| 5,751,269 | 5/1998 | Black et al. | 345/108 |

*Primary Examiner*—Richard A. Hjerpe
*Assistant Examiner*—Henry N. Tran
*Attorney, Agent, or Firm*—Rhodes & Mason, PLLC

[57] ABSTRACT

An improved solenoid and reset pin for a modular display apparatus for displaying indicia at a front thereof having a frame for rotationally mounting a plurality of pixels. Each pixel includes first and second display faces joined along respective adjacent edges. A triggering mechanism has a plurality of solenoids adapted for selective actuation to rotate selected ones of the pixels for changing the pattern of the desired display indicia and a plurality reset pins to return the pixels to an original position. The reset pins and the plungers for the solenoids include a spring and a rod extending axially outward from said spring to provide radial flexibility.

22 Claims, 8 Drawing Sheets

SOLENOID FOR SCANNED FLIP-DISK SIGN IMPROVEMENTS

FIELD OF THE INVENTION

The present invention relates to a display apparatus for displaying alphanumeric and/or graphical information. More particularly, the present invention relates to improved solenoids and reset pins in a display having a matrix of columns and rows of display elements that can be changed from one display state to another, in order to alter the arrangement of the display elements, thus changing the displayed alphanumeric and/or graphical information.

BACKGROUND OF THE INVENTION

The present invention provides improvements in changeable signs. One of the inventors of this application, Fred. M. Black, is the inventor of U.S. Pat. No. 4,761,905 entitled "Scanned Electromechanical Display" and U.S. Pat. No. 4,912,442 entitled "Scanned Electromechanical Alphanumeric Display Apparatus". Two of the co-inventors of this application, Fred. M. Black and G. Frank Dye are the co-inventors of U.S. Pat. No. 5,412,891 entitled "Changeable Sign". The disclosures of these three patents are hereby incorporated herein by reference. The '905 and '442 patents provide a description of certain of the prior art in the field of the present invention. Additional improvements are disclosed in Application Ser. No. 08/761,125, filed Dec. 6, 1996, based on Provisional Application Ser. No. 60/008795, filed Dec. 18, 1995, both of which are incorporated herein by reference.

The cited patents and applications disclose sign elements which can display alphanumeric or graphical information, through the selective arrangement of individual pixels. The pixels are rotatably mounted elements having multiple display faces, only one of which is noticeable to an observer at a time. The overall pattern of pixel display faces comprises the alphanumeric or graphical indicia of the sign. These prior patents disclose arrays of such pixels and actuator devices which pass behind the arrays to selectively rotate the pixels, causing a new display face of a rotated pixel to be noticeable and, thus, changing the displayed indicia of the sign. The present invention has these notions in common, but provides improved design features to create a superior product.

More specifically, the '442 patent disclosed a display apparatus having a plurality of rotationally mounted display elements that are arranged into a grid matrix of rows and columns, each display element having first and second display faces perpendicular to each other and joined along respective adjacent edges. Each display element also has first and second ramp surfaces rigidly connected along inside edges of and extending substantially away from a back surface of the first and second faces. The display apparatus includes a series of solenoids. which strike the ramp surfaces of the display elements, causing the display elements to rotate 90 degrees. The solenoids are mounted on a carriage that moves bidirectionally on a horizontal path behind the display apparatus. The electronics controlling the solenoids in the '442 apparatus cause the solenoids to fire and release for each pixel.

The shape and mounting of the pixels was a major improvement introduced by the '891 patent. The display faces were designed to be cylindrically concave, with the axis of concavity being parallel to the pixel's axis of rotation. Also, the ramp surfaces were given different configurations. These modifications allowed the pixels to be arranged in closer proximity to one another and greatly enhanced the performance of scanned pixel signs.

Periodically, one or more of the pixels may jam during operation of the sign. When a pixel jams, the rigid solenoid plunger or reset pin used to set or reset the pixel is unable to move the pixel and the result is damage to the sign. When the jammed pixel and the plunger or reset pin make contact as the carriage speeds by. something must give. Either the plunger or reset pin is bent or the jammed pixel is broken. In certain situations, the carriage may be damaged or knocked off track. If the plunger or reset pin is bent, the operation of an entire row of pixels is affected. Furthermore, the bent plunger or reset pin may cause additional damage or pixel jamming. The damage to the sign and costs to repair it are expensive and commercially undesirable.

Thus, there exists a need for a scanned pixel sign having solenoids and reset pins that prevent damage to themselves or the sign if the pixels become jammed.

SUMMARY OF THE INVENTION

This invention fulfills this need in the art by providing an improved solenoid and reset pin for use in a scanned pixel sign. The reset pins and the plungers for the solenoids include a spring and a rod extending axially outward from said spring to provide radial flexibility. The plungers and reset pins will bend enough to avoid damage to themselves or the sign when moving contact is made with a jammed pixel. The radially flexible plunger and reset pin also absorb shock and provide a smoother position transition when normal operating contact is made to set or reset a properly operating pixel.

Accordingly, one aspect of the present invention is to provide an improved solenoid plunger and reset pin for a modular display apparatus for displaying indicia at a front thereof. The display has a frame and a plurality of pixels rotationally supported in the frame and arranged into a matrix of rows and columns. The pixels each include at least two display faces, only one of which is displayed at a given time, for providing a desired arrangement of the display faces at the front of the display apparatus. A triggering mechanism provides bidirectional movement of solenoids and reset pins behind the pixels. The solenoids are selectively actuated to rotate selected ones of the pixels to change the display pattern. The plurality of reset pins reset the pixels rotated by the solenoid. Preferably, each solenoid plunger and reset pin includes a spring and an axial rod extending axially outward from the spring to provide radial flexibility.

BRIEF DESCRIPTION OF THE DRAWINGS

This invention will be better understood from a reading of the Detailed Description of the Preferred Embodiment along with a review of the drawings, wherein like items are indicated by the same reference number.

DETAILED DESCRIPTION OF THE PREFERRED EMBODIMENTS

Figure 1A:
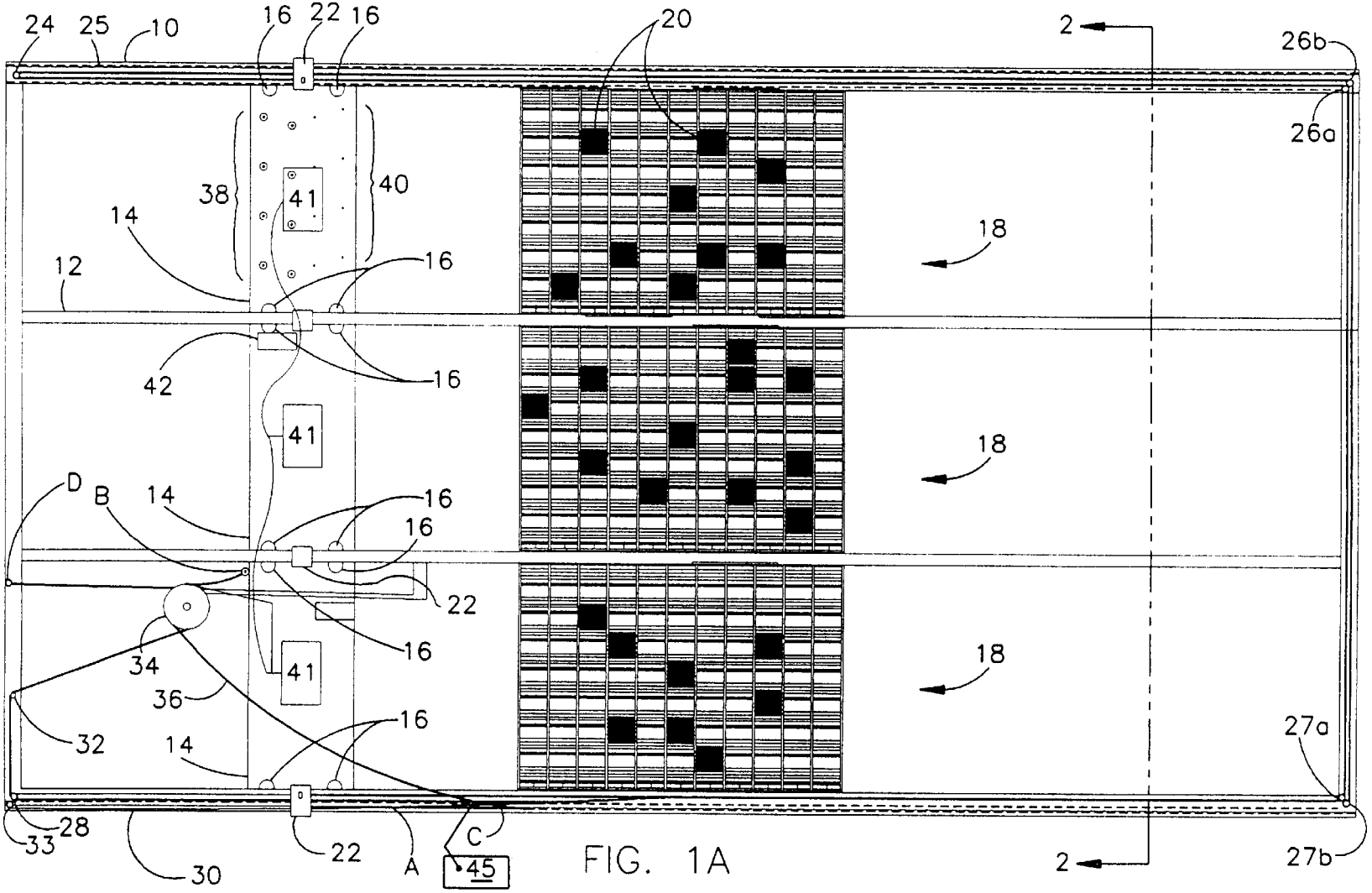
FIG. 1A is a rear elevation view of a display apparatus according to a preferred embodiment of the present invention.

With reference to FIG. 1A, the overall layout of the preferred embodiment of the present display apparatus is shown. The display apparatus has an inner frame 10, which is a square or rectangular section aluminum extrusion fabricated to the dimensions of the required sign. Attached to the frame are extruded aluminum horizontal support beams 12. Beams 12 serve two purposes: to provide guides for carriages 14 by capturing carriage wheels 16, and to capture grids 18 insuring that the horizontal and vertical positioning of the grids with relation to carriages 14 remains accurate and precise.

Figure 2:
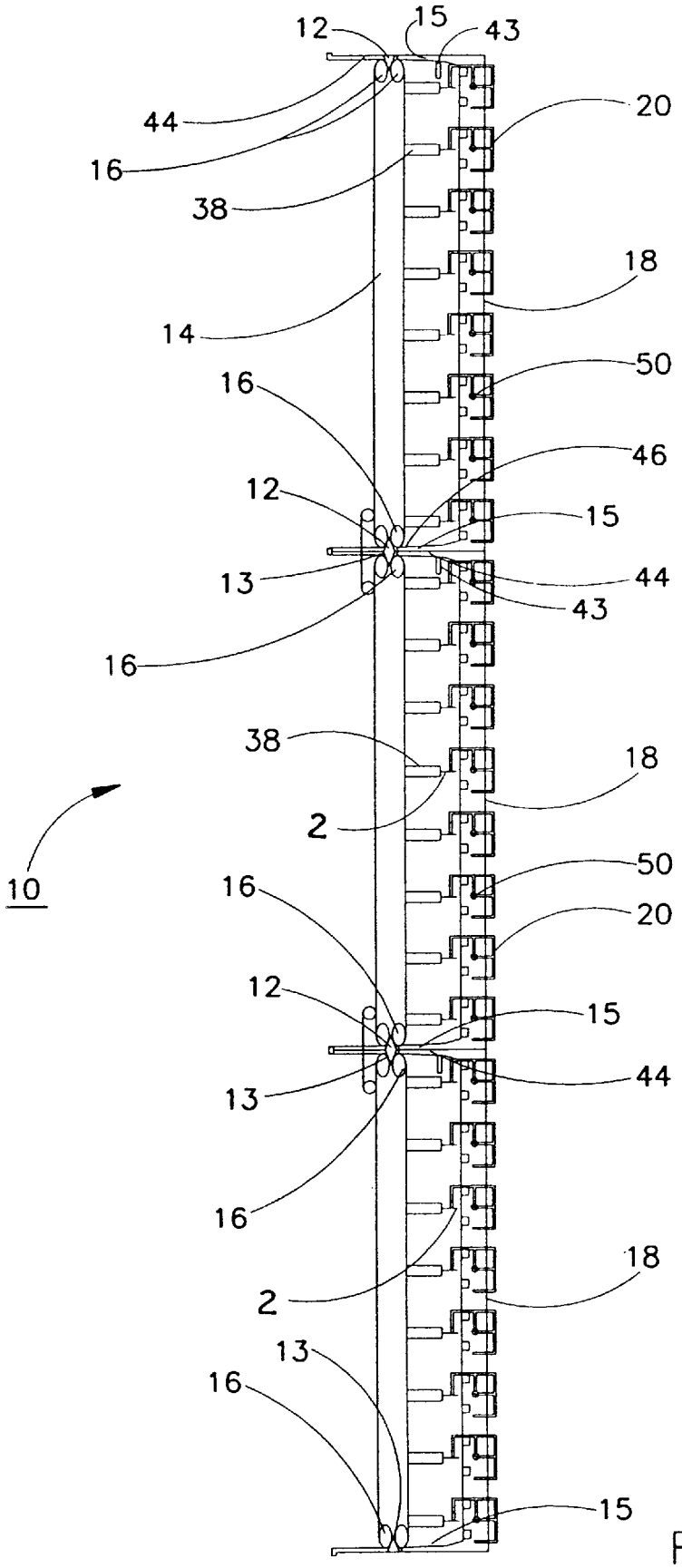
FIG. 2 shows an enlarged, partial sectional view of the assembled display apparatus of FIG. 1A, taken along lines 2—2 and looking in the direction of the arrows.

Each carriage 14 contains four wheels 16, two positioned at the top of the carriage and two positioned at the bottom of the carriage. As shown in FIG. 2, wheels 16 have an internal V-shaped groove 17 that rides on a complementary V-shaped protuberance 13 in the horizontal support beam 12 to assure horizontal and front-to-rear positioning of carriage 14. Protuberance 13 is recessed to prevent damage when handling. Therefore, three carriages would require four horizontal support beams. The design is such that multiple carriages may be vertically stacked to produce a tall sign. The preferred embodiment of the display apparatus contains up to six carriages stacked vertically. The limit depends on the weight and sturdiness of the frame structure and the practicality of handling large assembled signs.

Horizontal support beams 12 are also designed to capture and support vertically stacked grid modules 18, assuring the vertical positioning of one grid module to another. Only one vertical stack of modules is seen in the FIG. 1A for simplicity. Each horizontal support beam 12 captures vertically stacked grid modules 18 by way of a horizontal channel 15 (shown in FIG. 2) on the face of horizontal support beam 12 opposite protuberances 13. Vertical positioning of grids 18 is important since the unitary vision of the sign depends on uniform spacing of pixels 20. As can be seen from FIG. 1A, three vertically stacked grid modules 18 require four horizontal support beams 12 and three carriages 14.

Carriages 14 are ganged together vertically to move in unison. They are adapted for bidirectional motion, driven by a drive cable system that utilizes a single motor and a drum 24. The drum has a concave, or modified V surface (not shown) to insure proper wrapping of the drive cable 25. Several wraps of the drive cable insure sufficient friction to overcome any slippage when driving the carriages 14. The drum operates similar to a windlass.

Figure 1B:
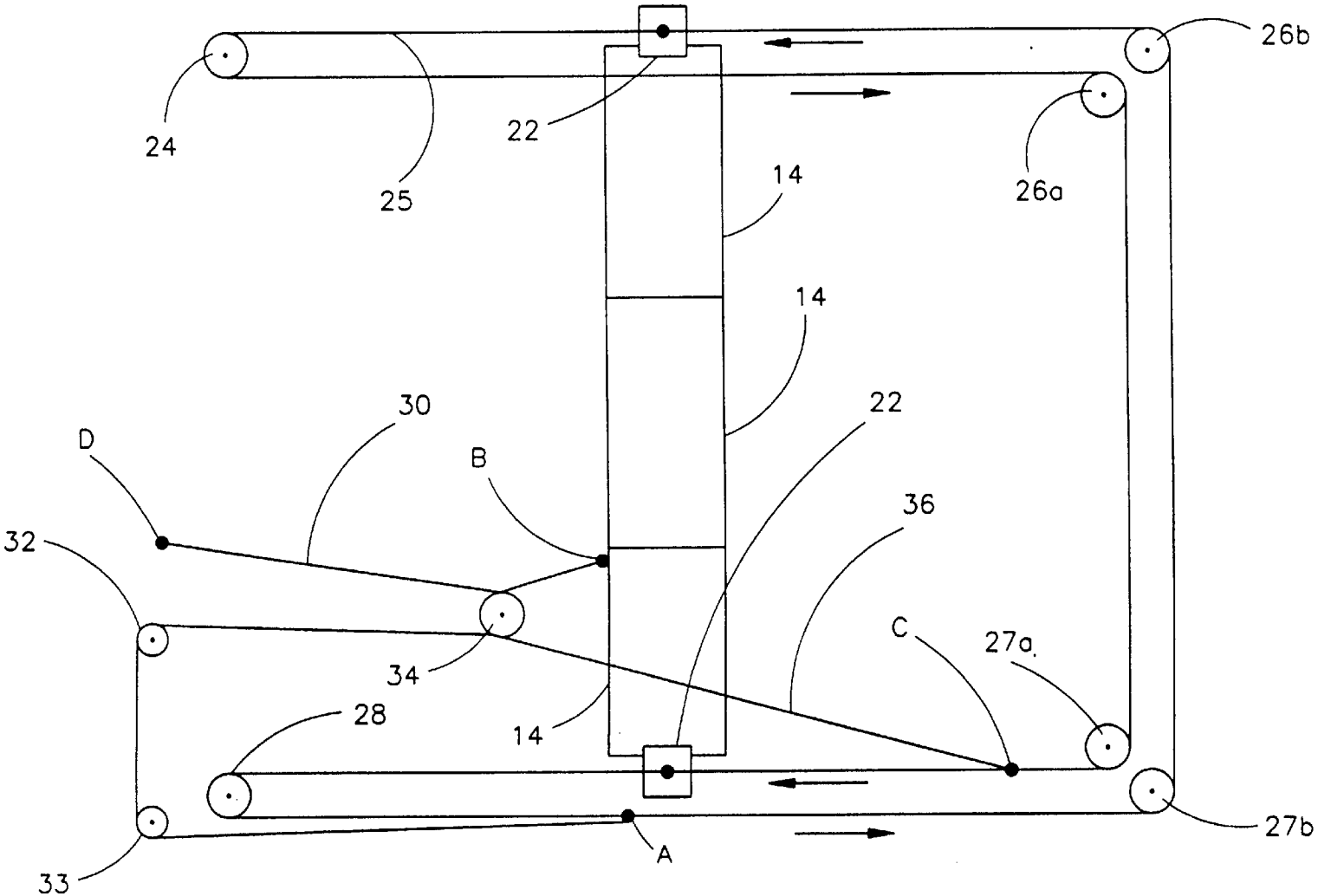
FIG. 1B is a schematic of the cable assembly of the embodiment shown in FIG. 1A.

In the preferred embodiment of the cable system shown schematically in FIG. 1B, drive cable 25 forms a continuous endless loop that runs around the top, one side, and bottom of inner frame 10 (shown in FIG. 1A). From drum 24, located at one end of the upper-most horizontal support beam 12, drive cable 25 travels along a path over drive cable pulley 26*a*, which is positioned at the opposite end of the upper-most horizontal support beam 12. Drive cable pulley 26*a* provides a 90° direction change to feed drive cable 25 down the side of inner frame 10, where drive cable pulleys 27*a* provide a further 90° direction change. Drive cable 25 then travels the length of the bottom-most horizontal support beam 12 where it is wrapped around drive cable pulley 28 to effect a 180° direction change.

Drive cable 25 is then routed back along inner frame 10 in a path parallel to that just described. As before, drive cable pulleys 27*b* and 26*b* provide the necessary 90° direction changes to guide drive cable 25 back to drum 24, where the loop is closed. Drive cable 25 is attached to the uppermost and lowermost carriages 14 by means of connecting brackets 22. The connecting brackets 22 are respectively connected to the portion of the drive cable 25 traveling in the same direction. The configuration of the drive cable 25 allows the portion of drive cable 25 connected to the uppermost carriage 14 to move in the same direction and at the same speed as a portion of drive cable 25 connected at the lowermost carriage 14. Thus, the configuration of drive cable 25 provides uniform horizontal motion for vertically stacked carriages 14.

Vertically stacked carriages 14 are also connected together by additional connecting brackets 22 as shown in FIG. 1A. Brackets 22 allow a small amount of vertical movement between stacked carriages 14 to prevent binding of the carriages on horizontal support beams 12, yet do not allow for any horizontal displacement between the carriages, resulting in constant horizontal alignment.

Shortening of the drive cable 25 and elimination of one drive cable pulley 26, 27 can be accomplished by routing a portion of the drive cable 25 diagonally across the inner frame to provide the direction change. However, in such an embodiment, there is a potential that the diagonal drive cable 25 will snag the carriage as it scans across the sign. Therefore, drive cable 25 is preferably routed away from carriages 14 as shown in FIGS. 1A and 1B along the periphery of the inner frame 10.

At this point, the vertically stacked carriages 14 are driven back and forth via the drum 24 and the drive cable 25. The carriages 14 require a control signal to control the pixels 20. In order to prevent the control signal cable 36 from becoming entangled or caught in the numerous moving part of the sign, a novel pulley system was designed to work in conjunction with the drive cable 25. The signal cable 36 is connected to one of the carriages 14 at point B and to a portion of the drive cable 25 traveling in the same direction as the carriages 14 at point C. A constant tension is kept on the signal cable 36 using a retriever cable 30 operating in conjunction with a movable pulley 34. The retriever cable 30 is fixed at one end to a point D, preferably on inner frame 10. The other end of the retriever cable 30 is routed around pulleys 32 and 33 and ultimately connected to the drive cable 25 at a portion traveling in the opposite direction of the cable at point A. Configuring the retrieval cable 30 in this manner allows the movable pulley 34 to move in the same direction as the carriages 14, but at half the speed, in order to compensate for the pulley action associated with signal cable 36. The net effect of this cable configuration provides constant tension for both the retriever cable 30 and the signal cable 36 as the carriages 14 move in both directions.

As seen in FIG. 1A, each carriage supports a series of eight solenoids 38 equally spaced vertically, except for the top, and a series of eight fixed reset pins 40 that are also equally spaced vertically, except for the top. The top reset pin and solenoid are vertically juxtaposed in order to provide clearances so the desired spacing between the grid modules can be achieved. The timing difference caused by the juxtaposition of the solenoid and reset pin is compensated by electronic means. Each carriage also contains a driver board 41 that controls the eight solenoids 38 on carriage 14. Reset pins 40 may be attached to a movable platform, so the reset function can be controlled. A fixed reset bar may be used if reset on retrace is desired. The reset pins may be replaced by solenoids so selective setting and resetting can be achieved, or a solenoid with an escapement containing a set and reset pin can be used to achieve selective set and reset finctions. Selective set and reset is especially useful if the sign is to be changed by a logic seeking technique. Other ways of using escapements or offset solenoid plunger pins could be used, but the embodiment described is the simplest.

Both the solenoids 38 and reset pins 40 are horizontally offset, so that there are four odd numbered solenoids in one column, four even numbered solenoids in a second column, four odd numbered reset pins a third column, and four even numbered reset pins in a fourth column. The use of separate columns provides a time lag for the even and odd rows of pixels to set or reset. This allows the pixels to be placed closer together, since vertically adjacent pixels do not rotate at the same time and therefore can each use marginal spaces above and below the pixel volumes during rotation, without interfering with one another.

The solenoids used in the preferred embodiment are either tubular or open frame solenoids and are mounted in holes at the front of the carriage. This technique makes the solenoids virtually self-aligning, eliminating the requirement of a fixture to properly align frame-type solenoids.

Figure 1C:
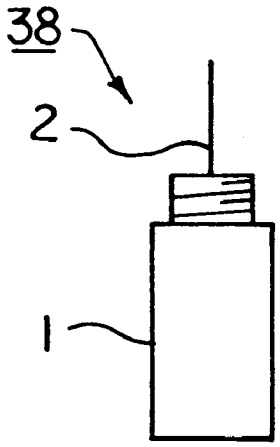
FIG. 1C PRIOR ART
FIG. 1C is a schematic of a prior art solenoid with a rigid plunger.
Figure 1D:
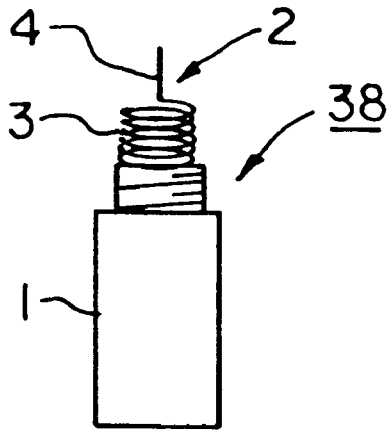
FIG. 1D is a schematic of an improved solenoid with a radially flexible plunger constructed according to the present invention.

FIGS. 1C–1F compare the prior art solenoids 38 and reset pins 40 with their improved counterparts, respectively. FIG. 1C depicts a typical solenoid 38 having a body 1 and a rigid, axially actuated plunger 2. The improved solenoid 38 of the present invention is shown in FIG. 1D. The solenoid 38 includes a body 1 and a plunger 2 comprising a spring 3 connected to an axially extending rod 4. The spring 3 provides radial flexibility for the plunger 2. By "radial flexibility" is meant the ability of the plunger to deflect from a strictly axial orientation without darnage. Providing the plunger 2 with radial flexibility allows for safe passage of the solenoid 38 past a jammed pixel 20 without damage to either the solenoid 38 or pixel 20, since the plunger 2 simply flexes enough to provide safe passage of the plunger 2 past the pixel 20. The spring also provides for smoother position transition of the pixels 20 during normal operation, since the spring 3 may axially compress to a slight extent to absorb some of the initial shock occurring when the laterally moving solenoid 38 actuates the plunger 2 into contact with a pixel 20. Note however, that too much axial compression may negatively affect pixel transitions.

Figure 1E:
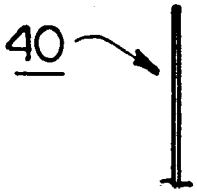
FIG. 1E PRIOR ART
FIG. 1E is a schematic of a prior art reset pin.
Figure 1F:
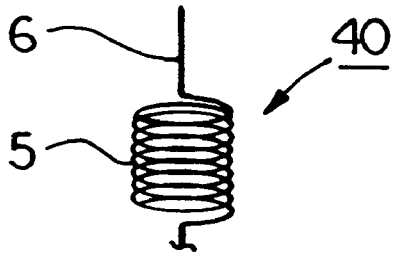
FIG. 1F is a schematic of an improved radially flexible reset pin constructed according to the present invention.

Preferably, the reset pins 40 are configured similarly to the plunger 2 of the improved solenoid 38. During retrace, the reset pins 40 contact set pixels 20 in order to reset the pixels 20 for the next scan. As with the prior art's solenoids shown in FIG. 1C, a rigid reset pin 40, as shown in FIG. 1E, is exemplary of the prior art. FIG. 1F depicts a radially flexible reset pin 40 having a spring 5 and a rod 6 extending axially therefrom. The radial flexibility of the reset pins 40 provide the same damage prevention and shock absorption benefits as the radially flexible plunger 2 discussed above. Although a spring and axially extending rod are specifically disclosed, any embodiment with a plunger providing radial flexibility is considered to fall within the scope of the disclosure herein and the claims which follow. An example of an alternative embodiment falling within the scope of claimed invention is a flexible rod or solenoid plunger constructed of a polymer or fiberglass.

The carriage 14 located closest to the vertical midpoint of the sign is provided with an interruptive optical position sensor board 42. The optical sensors sense the presence, or absence, of one of a series of flags 43 molded into each grid module 18. The information from the sensor board provides positioning and column count for the logic circuit (not shown). An alternative is to use positioning sensors for each carriage and logically "OR"ing them together to minimize errors, however, the preferred embodiment uses one board. The sensors use synchronous detection to prevent interference from any ambient light.

The vertically middlemost carriage also contains a "HOME" position sensor, that uses a "Hall Effect" device to determine the carriage's "HOME" position. A second sensor could be used to provide information when the carriage is at the opposite position, however, this is optional.

FIG. 2 shows a sectional view of the assembled display apparatus of FIG. 1A along line 2—2. FIG. 2 shows inner frame 10 and horizontal support beams 12 having protuberances 13 and horizontal channels 15. Horizontal channels 15 receive and capture mounting tabs 44 of vertically stacked grid modules 18. Mounting tabs 44 are anchored to horizontal channel 15 with a pin 46. Also shown in the figure are solenoids 38 secured to the front of carriage 14, and pixels 20 mounted in grid modules 18.

Figure 3:
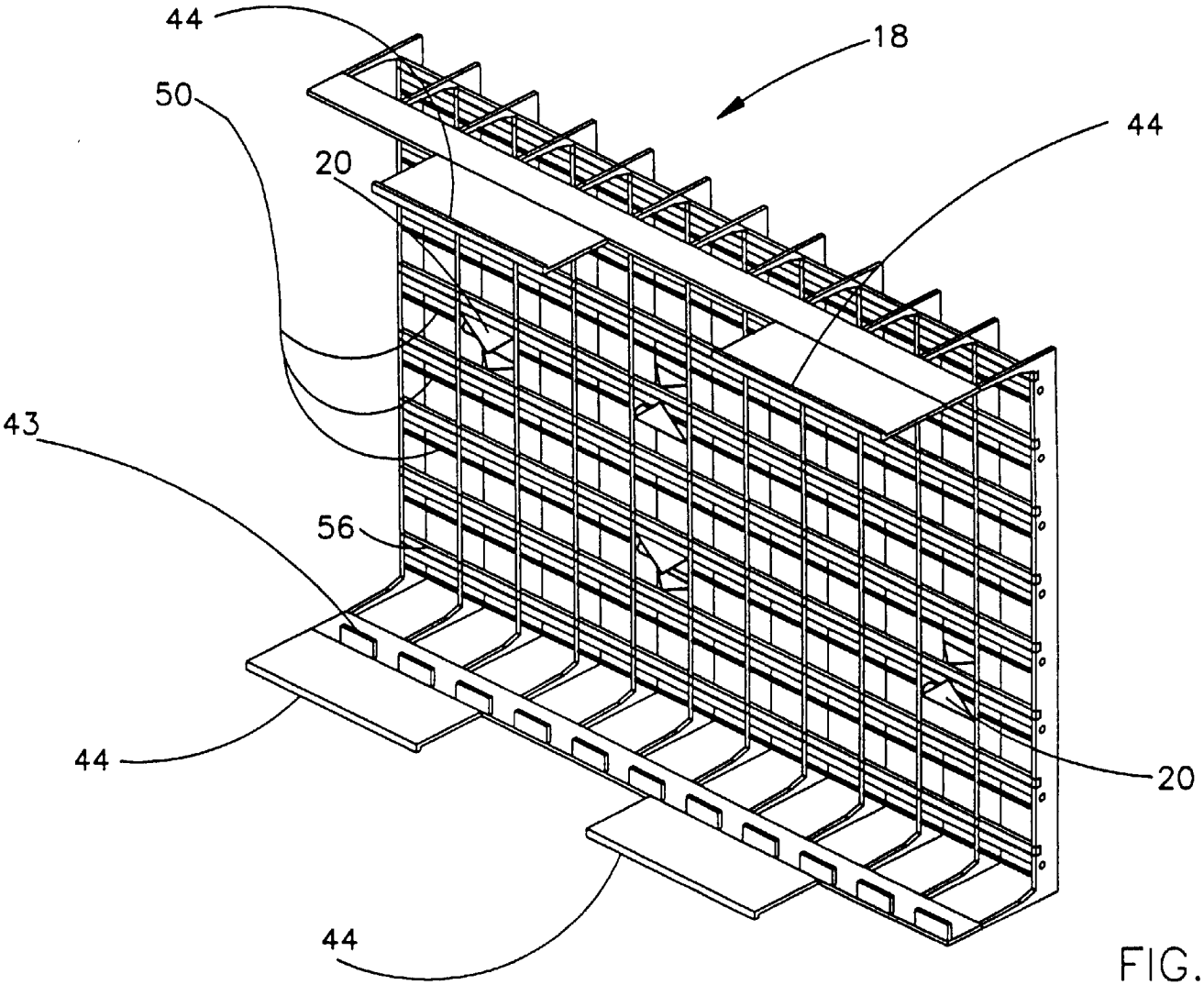
FIG. 3 is an enlarged rear perspective view of an individual grid module.

FIG. 3 shows an individual grid module 18. In the preferred embodiment, grid module 18 is a one-piece injection-molded matrix approximately 12 inches high by 15 inches long. It holds 88 pixels in an array of 8 high by 11 wide. An axle so extends along each row of the module 18. Pixels 20 are loaded through the front of the grid, and snapped onto axles 50 to provide rotational engagement. Preferably, the pixels have a C-shaped aperture at their center to provide the snap-on engagement. Once in place, a clamp may be used to more securely engage the pixel 20 onto the axle 50. The single axle per row configuration eliminates the need for placing axle tabs directly on the pixels 20 and having corresponding slots on the module 8. The pixels can rotate 90° and are stopped in one of two stable positions by stop tabs 56 molded into the grid.

The grid also has molded-in flags 43 that provide information as to when solenoids 38 are to fire. Flags 43 interrupt light between a light source and receiver (not shown) on the carriage. Molding the flags to the grid module provides accurate positioning relative to each column, which eliminates adjustments between the flags and pixel position. Grid module 18 also has two mounting tabs 44 at the top of the rear and two mounting tabs 44 at the bottom of the rear of the grid module. Top and bottom mounting tabs 44 are staggered with respect to each other, and are attached to horizontal channel 15 in horizontal support beams 12 of inner frame 10.

Figure 4:
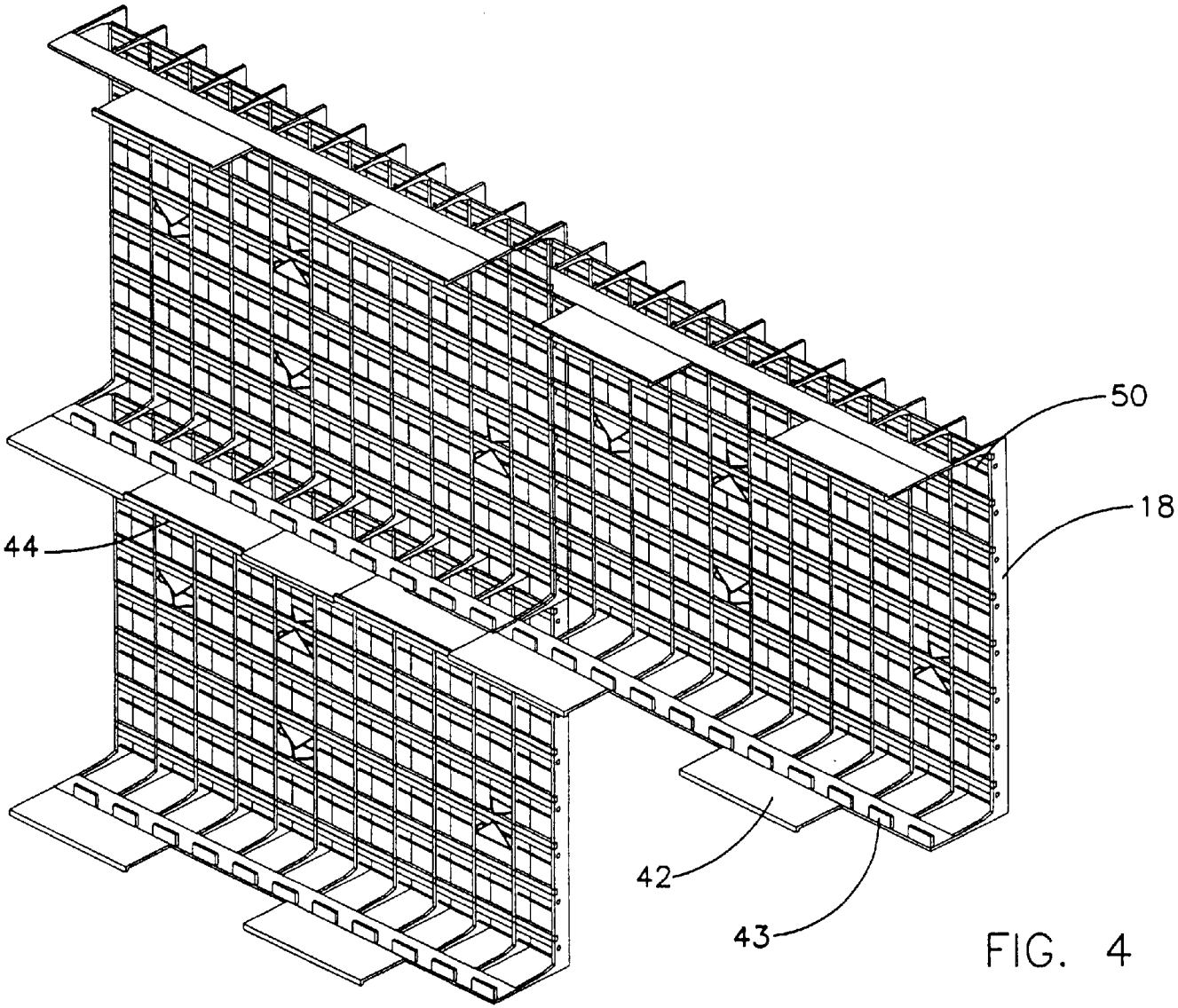
FIG. 4 is a view of several of the grid modules, showing their stackability, both horizontally and vertically, forming the display grid of the display apparatus.

As shown in FIG. 4, grid modules 18 are designed to stack both horizontally and vertically, forming the display face of the sign. The dimensions of grid modules 18 and mounting schemes are designed so that the grid modules may be placed close enough together, in the vertical and horizontal planes, so that they appear as one continuous large grid. Since one horizontal support beam 12 captures two vertically adjacent grid modules 18, the lower portion of an upper module and an upper portion of a lower module, the mounting tabs 44 are staggered to fit interstitially into the same horizontal channel 15 on horizontal support beam 12.

FIGS. 5–7 depict side views of three alternative embodiments of pixels 20. Pixels 20 have a first display face 60 and a second display face 62, which are joined along respective adjacent edges 64. Pixels 20 also include sloping ramp surfaces 68, which, when struck by solenoids 38 or reset pins 40, cause the pixels to rotate about axis 70. Pixels 20 are designed such that the center of gravity of the pixels interacts with an external force applied by the solenoids to provide smooth rotation of the pixels with a minimum of bounce.

Figure 5A:
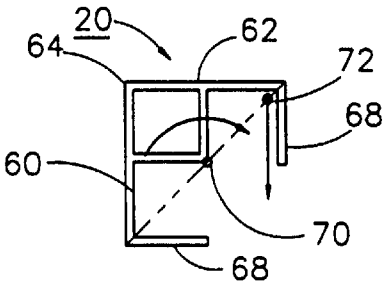
FIGS. 5A–5C show sequential side views of a first embodiment, second embodiment and third embodiment of the individual pixels, demonstrating the pixels' weight distribution during operation.
Figure 5B:
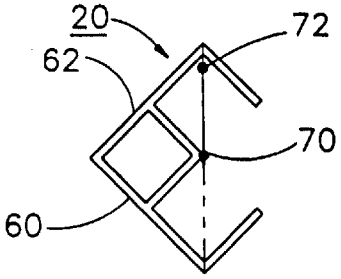
Figure 5C:
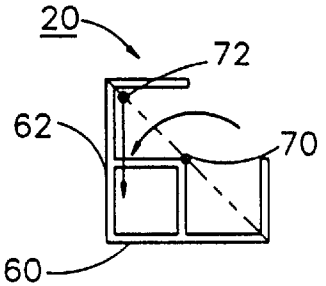

In the embodiment shown in FIGS. 5A–5C, the pixel has a fixed weight 72 to locate the center of gravity, CG, of the assembly to a point approximately 45° up from behind the axis of rotation 70. Weight 72 is designed to distribute the center of gravity symmetrically around the 45° line when pixel 20 is in the reset position (FIG. 5A). The CG moves directly above axis of rotation 70 when pixel 20 is in transition at a 45° angle (FIG. 5B). The CG then moves to a position 45° up from the front of axis of rotation 70 when pixel 20 is in the set position (FIG. 5C). The mass and position of the CG assists in switching pixel 20 from the set, or reset, position to the reset, or set, position when reset pins 40 or solenoids 38 strike their respective ramp surfaces 68. That is, the center of gravity of the pixels has two stable equilibria—the set and reset positions—and the transitions between them are unstable, inducing the pixel to remain in one of the equilibrium positions once so directed.

Figure 6A:
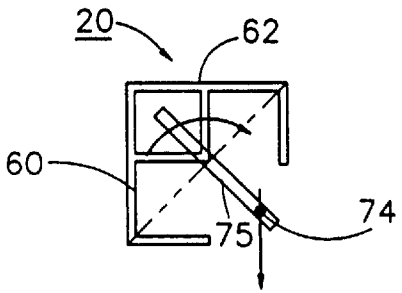
FIGS. 6A–6C show sequential side views of a first embodiment, second embodiment and third embodiment of the individual pixels, demonstrating the pixels' weight distribution during operation.
Figure 6B:
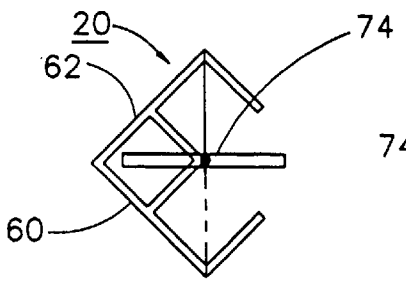
Figure 6C:
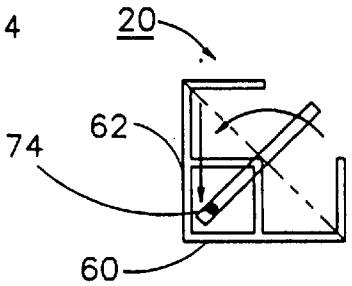

FIGS. 6A–6C show an alternate embodiment, where the CG is variable and is achieved by a weight that is allowed to move diagonally across the vertical plane of axis of rotation 70 to shift the CG. One approach is to use ball bearing(s) 74 in a small tube 75 attached to axis 70 (FIG. 6A). As pixel 20 rotates past the 45° point (FIG. 6B), bearing(s) 74 shift from one end of tube 75 to the other (FIG. 6C). Sand, glass balls, lead shot, or any other flowvable material may be used in tube 75.

Figure 7A:
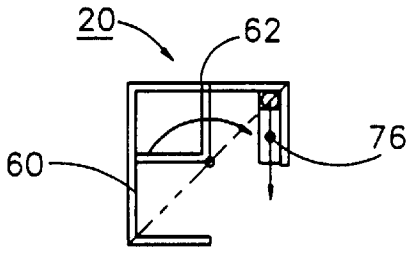
FIGS. 7A–7C show sequential side views of a first embodiment, second embodiment and third embodiment of the individual pixels, demonstrating the pixels' weight distribution during operation.
Figure 7B:
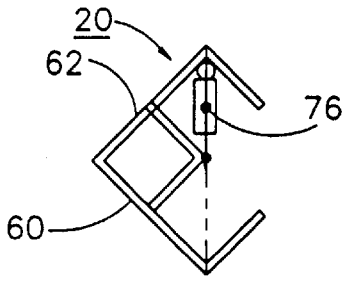
Figure 7C:
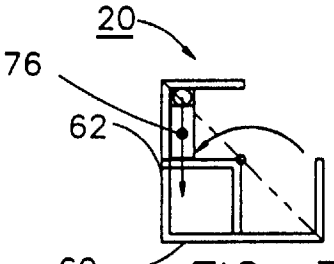

FIGS. 7A–7C show another embodiment, where the variable CG is achieved by means of a suspended or swinging weight 76, which is attached to the top far end of pixel 20. Since weight 76 hangs plumb, the CG is initially behind axis of rotation 70 (FIG. 7A). As pixel 20 rotates beyond 45° (FIG. 7B), the CG shifts to in front of the axis of rotation 70 (FIG. 7C).

Figure 8:
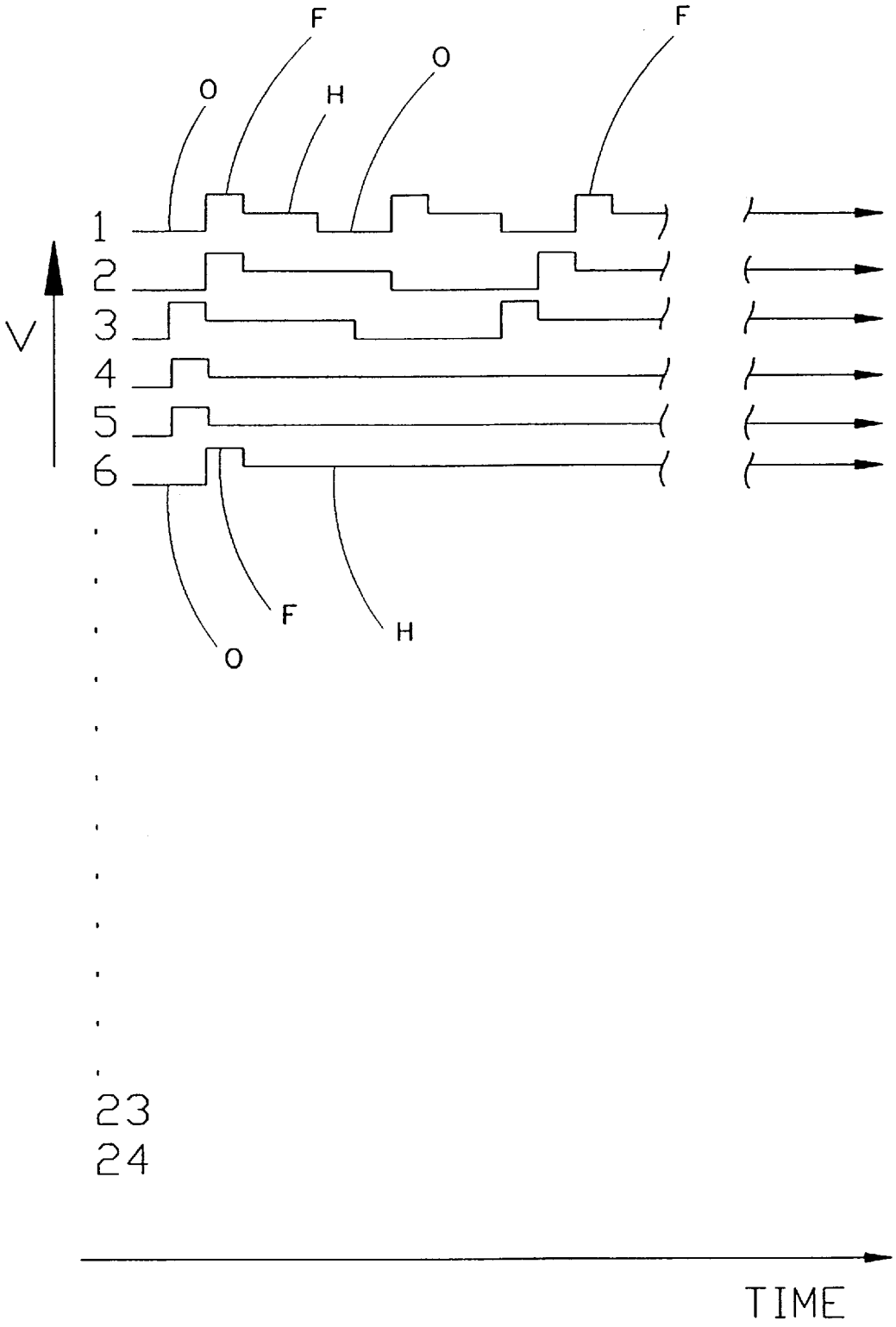
FIG. 8 shows a state diagram of output voltages from the electronics system that are applied to the solenoids.

FIG. 8 shows a state diagram of output voltage signals applied to various solenoids 38 from a computer 45 (shown in FIG. 1). The output voltages represented in FIG. 8 are arbitrary and are meant only to illustrate the operation of solenoids 38. The basic operation of a solenoid 38 is as follows: the solenoid fires (indicated in the state diagram by the first spike in voltage) ejecting plunger 2 (as shown in FIG. 2), which strikes ramp surface 68 of pixel 20, causing the pixel to rotate about axis 70; the solenoid is then held in the fired position (indicated in the state diagram by the intermediate drop in voltage) as long as there is a required change of state for the next horizontally adjacent pixel; the solenoid then releases (indicated in the state diagram by the drop to zero voltage), pulling the plunger back inside.

Solenoids of the prior art are fired or released at each column of pixels. If adjacent columns of pixels all require setting, the solenoid would release and fire for each column. This method requires solenoids with lifetimes in excess of 5,000,000 cycles. Full voltage was also applied to each solenoid, causing peak currents in excess of 17 amps, at 13.5 volts, and average currents of over 10 amps.

The solenoid used in the present invention improves upon the prior art by incorporating a two-step firing method. The improved two-step firing method will not change the state of the solenoid plunger 2 unless there is a required change of state for the next horizontally adjacent pixel 20. This significantly reduces the number of cycles that a solenoid has to fire, since any contiguous set or reset only requires one firing cycle. The two-step firing cycle consists of applying full voltage F to solenoid 20 for a fixed period, about 40 milliseconds in the preferred embodiment, and a significantly lower "HOLD" voltage H for the remaining time the solenoid must be activated. The current necessary to fire solenoid 38 is 2–3 times higher than the current required to "tHOLD" the solenoid. The voltage on each solenoid 38 is removed (reference voltage O) when the plunger 38 is required to return to it position inactivated. Solenoids 38 are preferably selected at higher voltages, such as 24–36 volts DC, as opposed to 12 volts DC. Increasing the operating voltages reduces the current requirements, which reduces voltage drops due to the resistance of the signal cable 36. Reducing operating currents also allows for the use of smaller gauge wire, which reduces manufacturing costs. However, operating at higher voltages requires more stringent design to minimize safety hazards.

Therefore, the present invention provides a changeable sign that is fully modular, both in the horizontal and vertical directions. The pixels of this changeable sign undergo smooth rotation with a minimum of bounce. Such a smooth rotation is effectuated by configuring the center of gravity of the pixels so as to interact with an external force applied to the pixels.

The changeable sign operates on reduced power levels by driving the carriages, which carry solenoids adapted for rotation of the pixels with only a single cable drive system. Also, the sign reduces power consumption by using a two-step fire-and-hold process wherein the solenoid drive voltage is reduced after firing to hold the solenoid in position.

The embodiments shown and described herein have been for the purpose of illustration of the invention. Those of ordinary skill in the art will appreciate that the invention can be carried out in various forms other than those specifically shown. Such variations are deemed to be within the scope of the claims. Also, various combinations and subcombinations of the features of the invention can be used without going beyond the scope of the invention.

What is claimed is:

1. An improved solenoid plunger and reset pin for a modular display apparatus for displaying indicia at a front thereof, having a frame; a plurality of pixels rotationally supported in the frame for providing a desired arrangement of display faces on said pixels at the front of the display apparatus; a triggering mechanism adapted for trasverse movement behind the pixels, the triggering mechanism having a plurality of solenoids having plungers adapted for selective actuation to rotate selected ones of the pixels and a plurality of reset pins for resetting the pixels rotated by said solenoids, wherein said solenoid plungers and said reset pins are radially flexible.

2. The improved solenoid plunger and reset pin of claim 1 wherein said radially flexible solenoid plunger and said reset pin each include a spring.

3. The improved solenoid plunger and reset pin of claim 2 wherein said springs of both said radially flexible solenoid plunger and said reset pin are adapted to minimize axial compression while providing radial flexibility.

4. The improved solenoid plunger and reset pin of claim 3 wherein said springs include substantially adjacent coils, said substantially adjacent coils providing said minimized axial compression.

5. The improved solenoid plunger and reset pin of claim 2 wherein both said plunger and reset pin further including an axial rod portion extending axially from said spring portion.

6. An improved solenoid plunger and reset pin for a modular display apparatus for displaying indicia at a front thereof, having a frame; a plurality of pixels rotationally supported in the frame and arranged into a matrix of rows and columns, the pixels each including at least two display faces, only one of which is displayed at a given time, for providing a desired arrangement of the display faces at the front of the display apparatus; a triggering mechanism adapted for bidirectional movement behind the pixels, the triggering mechanism having a plurality of solenoids adapted for selective actuation to rotate selected ones of the pixels for changing the pattern of the desired display indicia and a plurality of reset pins for resetting the pixels rotated by said solenoid, wherein both said improved solenoid plunger and said reset pin include a spring and an axial rod extending axially outward from said spring to provide radial flexibility.

7. An improved solenoid for a display apparatus for displaying indicia at a front thereof that includes:

a frame;

plurality of pixels rotationally supported in the frame and arranged into a row, the pixels each including at least two display faces, only one of which is displayed at a given time, for providing a desired arrangement of the display faces at the front of the display apparatus; and a triggering mechanism adapted for transverse bidirectional movement behind the pixels, the triggering mechanism having a plurality of solenoids adapted for selective actuation to rotate selected ones of the pixels for changing the pattern of the desired display indicia, wherein said solenoid has a plunger that is radially flexible.

8. The improved solenoid plunger of claim 7 wherein said radially flexible solenoid plunger includes a spring.

9. The improved solenoid plunger of claim 8 wherein said spring of said radially flexible solenoid plunger is adapted to minimize axial compression of said plunger during actuation of the solenoid while providing radial flexibility.

10. The improved solenoid plunger of claim 9 wherein said spring includes substantially adjacent coils, said substantially adjacent coils providing said reduced axial compression.

11. The improved solenoid plunger of claim 8 further including an axial rod portion extending axially from said spring portion.

12. An improved solenoid for a display apparatus for displaying indicia at a front thereof that includes:

a frame;

a plurality of pixels rotationally supported in the frame and arranged into a row, the pixels each including at least two display faces, only one of which is displayed at a given time, for providing a desired arrangement of the display faces at the front of the display apparatus; and a triggering mechanism adapted for bidirectional movement behind the pixels, the triggering mechanism having a plurality of solenoids adapted for selective actuation to rotate selected ones of the pixels for changing the pattern of the desired display indicia, wherein said improved solenoid plunger includes a spring and an axial rod ex-ending axially outwvard from said spring to provide radial flexibility.

13. An improved reset pin for a modular display apparatus for displaying indicia at a front thereof, having a frame; a plurality of pixels rotationally supported in the frame and arranged into a matrix of rows and columns, the pixels each including at least two display faces, only one of which is displayed at a given time, for providing a desired arrangement of the display faces at the front of the display apparatus; a triggering mechanism adapted for transverse bidirectional movement behind the pixels, the triggering mechanism having a plurality of solenoids adapted for selective actuation to rotate selected ones of the pixels for changing the pattern of the desired display indicia and a plurality of reset pins for resetting the pixels rotated by said solenoid, wherein said improved reset pin is radially flexible.

14. The improved reset pin of claim 13 further including a spring.

15. The improved reset pin of claim 14 further adapted to reduce axial compression during contact with a pixel while providing radial flexibility.

16. The improved reset pin of claim 15 wherein said spring includes substantially adjacent coils, said substantially adjacent coils providing said reduced axial compression.

17. The improved reset pin of claim 14 farther including an axial rod portion extending axially from said spring portion.

18. An improved reset pin for a modular display apparatus for displaying indicia at a front thereof, having a frame; a plurality of pixels rotationally supported in the frame and arranged into a matrix of rows and columns, the pixels each including at least two display faces, only one of which is displayed at a given time, for providing a desired arrangement of the display faces at the front of the display apparatus; a triggering mechanism adapted for bidirectional movement behind the pixels, the triggering mechanism having a plurality of solenoids adapted for selective actuation to rotate selected ones of the pixels for changing the pattern of the desired display indicia and a plurality of reset pins for resetting the pixels rotated by said solenoid, wherein said improved reset pin includes a spring and an axial rod extending axially outward from said spring to provide radial flexibility.

19. An improved solenoid having a radially flexible plunger for a scanned pixel display comprising:

a body mountable to a moveable carriage in a scanned pixel display; and a radially flexible plunger adapted to flexibly bypass jammed pixels during a scan or retrace as needed, said plunger axially actuable to control positioning of the pixels.

20. The improved solenoid of claim 19 wherein said plunger includes a spring and an axially extending rod extending from said spring.

21. A method for the improved operation of a scanned pixel display comprising:

providing a triggering mechanism with a solenoid having a radially flexible plunger;

scanning a row of pixels with the triggering mechanism;

selectively actuating the solenoid to set at least one desired pixel; and when the plunger encounters a jammed pixel, radially flexing the plunger to avoid damage.

22. A method for the improved operation of a scanned pixel display comprising:

providing a triggering mechanism with a solenoid having a radially flexible plunger and a radially flexible reset pin;

scanning a row of pixels with the triggering mechanism;

selectively actuating the solenoid to set at least one desired pixel;

retracing the row of pixels to reset the at least one desired pixel set during scanning; and when the plunger or reset pin encounters a jammed pixel, radially flexing the plunger or the reset pin to avoid damage.

* * * * *

UNITED STATES PATENT AND TRADEMARK OFFICE

CERTIFICATE OF CORRECTION

PATENT NO : 6,028,582

DATED : February 22, 2000

INVENTOR(S) : Drew et al.

It is certified that error appears in the above-identified patent and that said Letters Patent are hereby corrected as shown below:

On the title page, the correct spelling of the Assignee is ReaderVision, Inc.

In Column 10, line 7, "ex-ending" should be --extending--.

In Column 10, line 7, "outvard" should be --outward--.

Signed and Sealed this

Third Day of April, 2001

Nicholas P. Godici

*Attest:*

NICHOLAS P. GODICI

*Attesting Officer*

*Acting Director of the United States Patent and Trademark Office*